US007900387B2

(12) United States Patent
Lee et al.

(10) Patent No.: US 7,900,387 B2
(45) Date of Patent: Mar. 8, 2011

(54) PRICE DISPLAY APPARATUS

(75) Inventors: Jae Chan Lee, Gyeonggi-do (KR); Yong Gil Namgung, Gyeonggi-do (KR); Hyun Hak Kim, Gyeonggi-do (KR); Seok Min Woo, Gyeonggi-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 111 days.

(21) Appl. No.: 12/273,988

(22) Filed: Nov. 19, 2008

(65) Prior Publication Data

US 2010/0088937 A1 Apr. 15, 2010

(30) Foreign Application Priority Data

Oct. 15, 2008 (KR) ..... 10-2008-0101137

(51) Int. Cl.
*G09F 3/18* (2006.01)

(52) U.S. Cl. ..... 40/661.03; 40/642.02; 235/383

(58) Field of Classification Search ..... 40/661.03, 40/124.01, 124.05, 5
See application file for complete search history.

(56) References Cited

U.S. PATENT DOCUMENTS 5,553,412 A * 9/1996 Briechle et al. ..... 40/124.01
5,816,550 A * 10/1998 Watanabe et al. ..... 248/222.11
6,000,611 A * 12/1999 Dalton et al. ..... 235/383
7,461,782 B2 * 12/2008 Andersson et al. ..... 235/383

FOREIGN PATENT DOCUMENTS

KR 10-2001-0067901 A 7/2001

* cited by examiner

*Primary Examiner* — Lesley Morris
*Assistant Examiner* — Shin Kim
(74) *Attorney, Agent, or Firm* — McDermott Will & Emery LLP

(57) ABSTRACT

Provided is a price display apparatus including a plate-shaped label having a price displaying unit; and a holder coupled to one side of the label and having a fixing portion protruding outward from the label.

11 Claims, 3 Drawing Sheets

[FIG. 1]
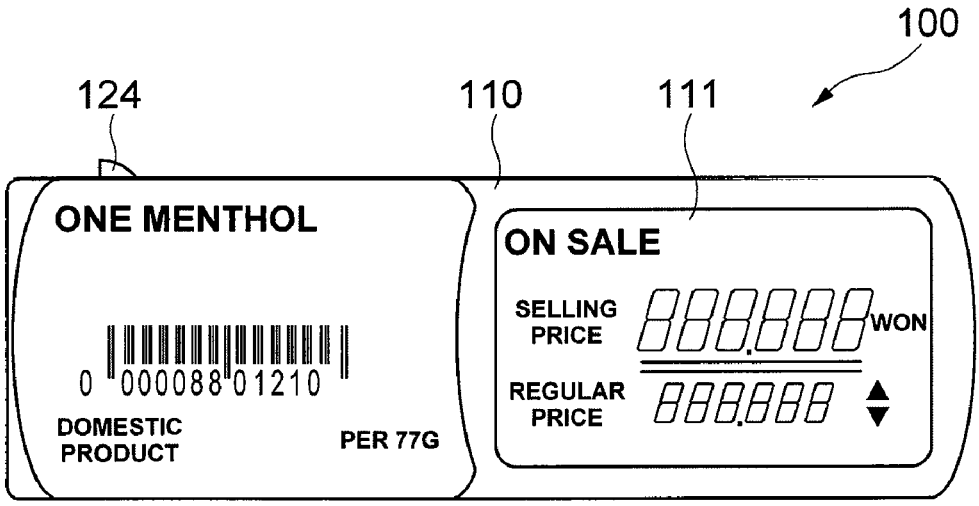
[FIG. 2]
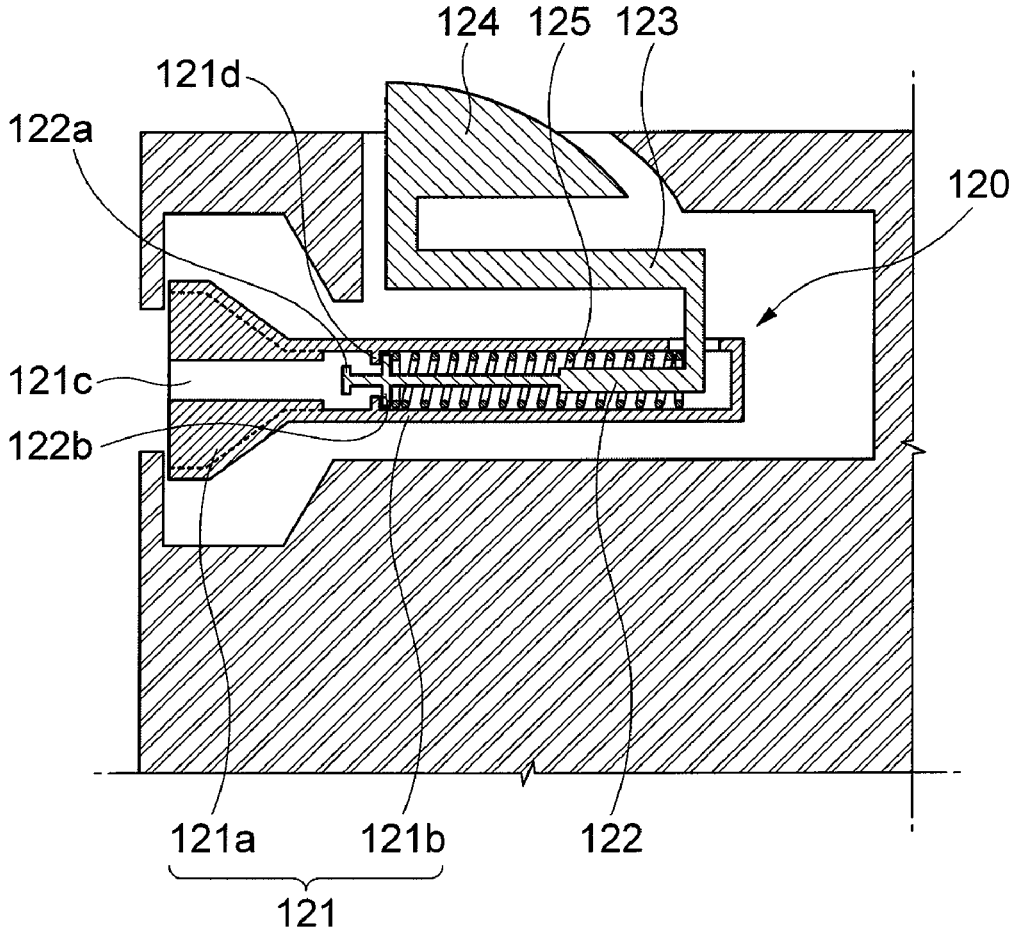

[FIG. 3]
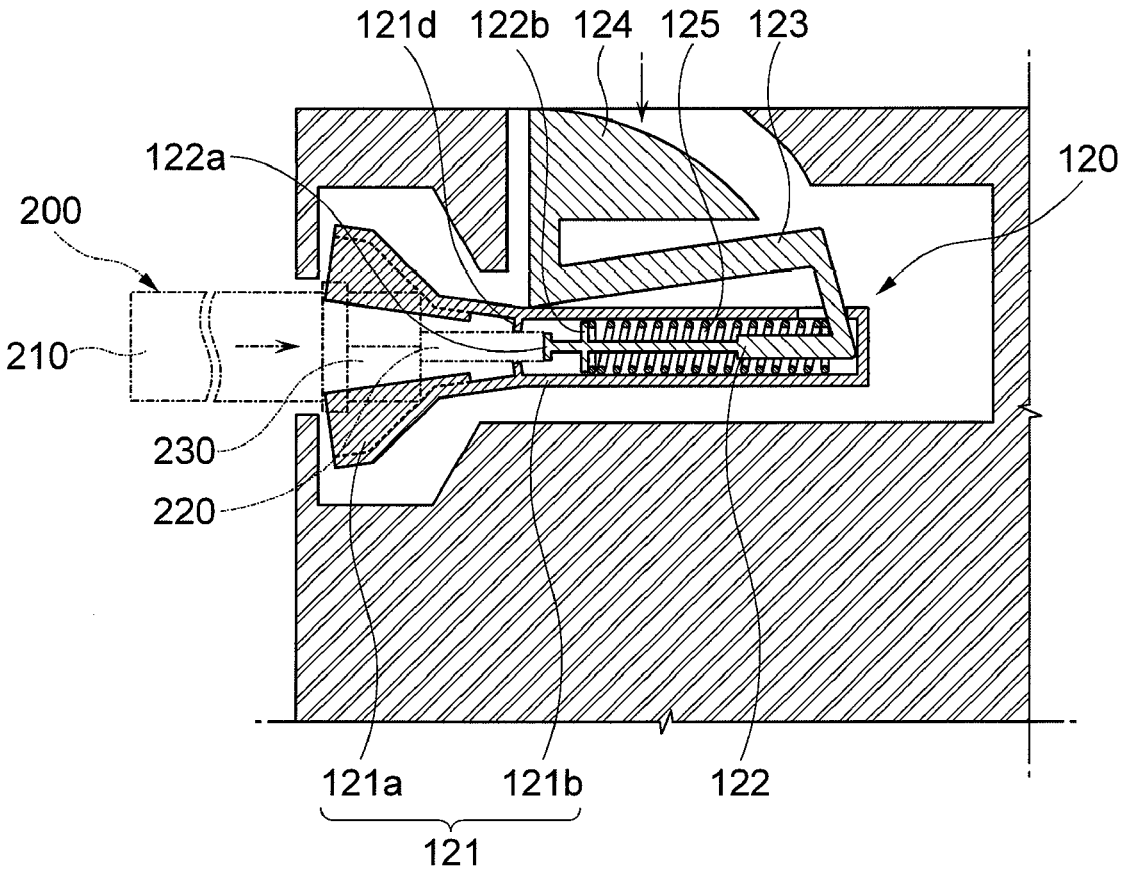
[FIG. 4]
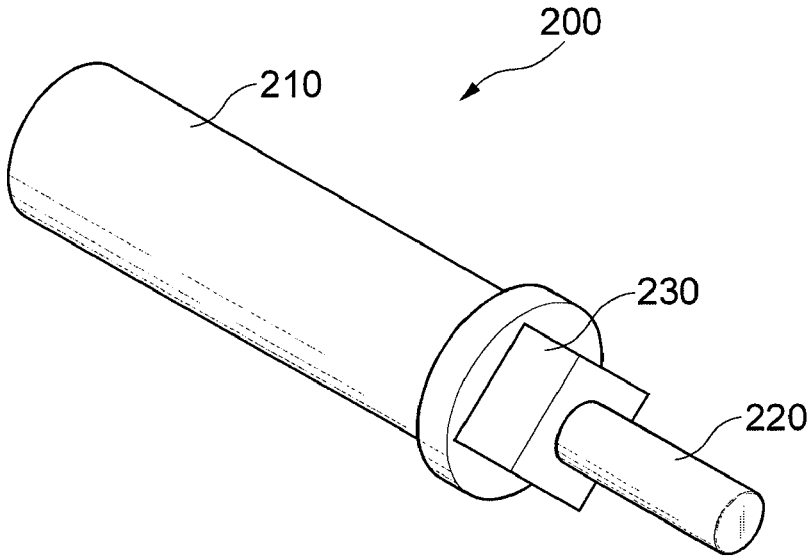

[FIG. 5]
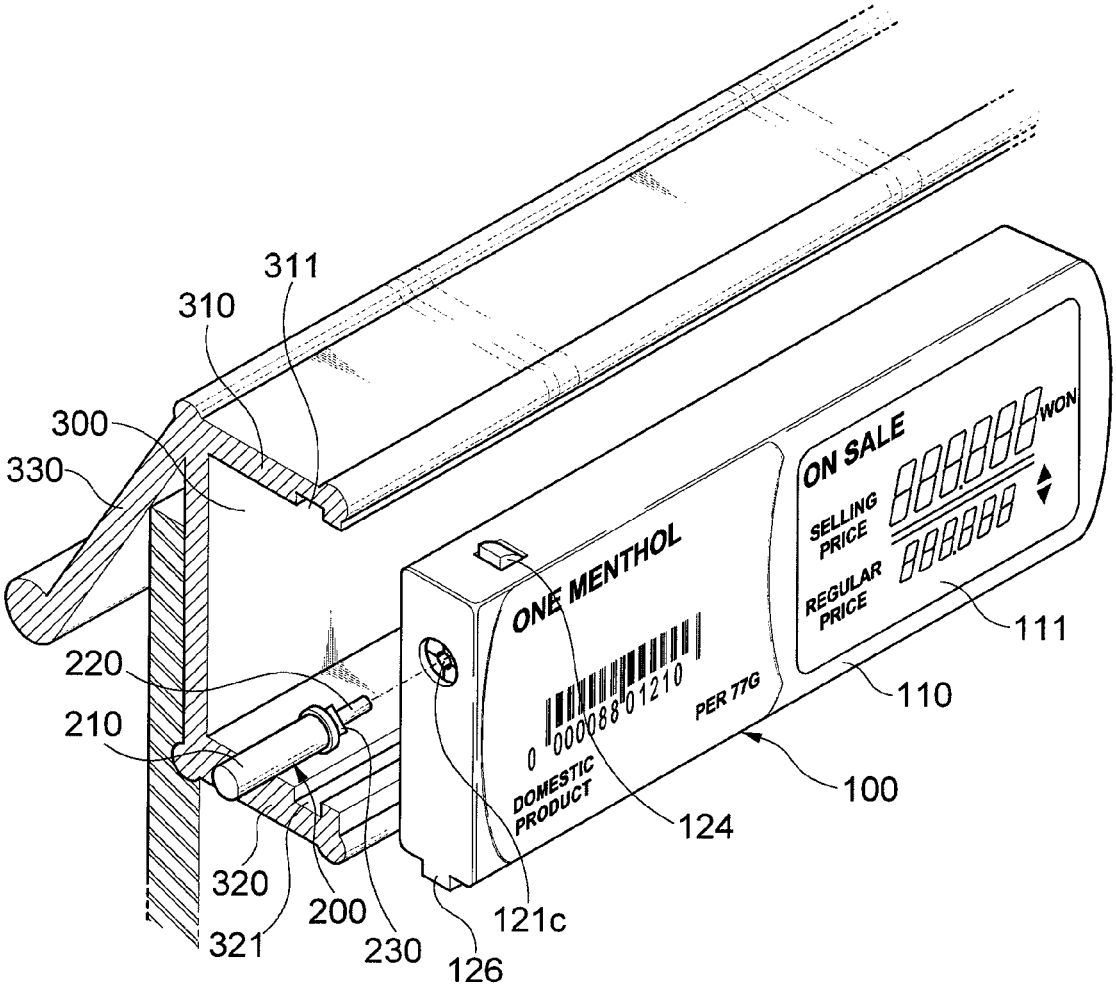

PRICE DISPLAY APPARATUS

CROSS-REFERENCE TO RELATED APPLICATIONS

This application claims the benefit of Korean Patent Application No. 10-2008-0101137 filed with the Korea Intellectual Property Office on Oct. 15, 2008, the disclosure of which is incorporated herein by reference.

BACKGROUND OF THE INVENTION

1. Field of the Invention

The present inventive concept relates to a price display apparatus, and more specifically, to a price display apparatus in which a holder is mounted in one side of a label for displaying a price and elastically operated by a separate dedicated key, thereby preventing the label from being stolen.

2. Description of the Related Art

In general, a large number of products are arranged on display stands of discount stores, department stores, and convenience stores. Price tags on which the prices of the products are written are attached to upper or lower ends of the display stands.

Further, each of the price tags has a barcode printed thereon, the barcode including the price and code information of the corresponding product. When the product at the position is changed or the price of the product is changed, a manager should replace the price tag individually. Therefore, the replacing operation is very annoying, and takes a lot of time.

In particular, when many kinds of products are arranged on display stands, the prices of the respective product should be managed individually. Whenever the prices of products are varied, a manager should replace the price tags one by one. Further, since the replacing operation is performed manually, errors may occur.

To solve such a problem, an electronic shelf label (ESL) has been recently developed, which can change the price information of a product in real time and can display additional information of the product including price per unit, sale price, regular price, product display position, currency, point information, display quantity and so on.

However, since the conventional ESL is disposed on an upper or lower end of a display stand through a simple structure or is attached to the display stand through a magnet attached to one side of the ESL, the ESL can be easily attached to and detached from the display stand.

Since the ESL can be easily attached to and detached from the display stand, the ESL may be lost and stolen. In this case, a financial loss may occur.

Further, a wireless communication chip for radio frequency (RF) communication is mounted in the conventional ESL. Therefore, when an attachment such as magnet or metal is used, the communication may be interrupted.

SUMMARY OF THE INVENTION

An advantage of the present invention is that it provides a price display apparatus in which a holder is mounted in one side of a label for displaying a price and elastically operated by a separate dedicated key, thereby preventing the label from being stolen Additional aspect and advantages of the present general inventive concept will be set forth in part in the description which follows and, in part, will be obvious from the description, or may be learned by practice of the general inventive concept.

According to an aspect of the invention, a price display apparatus comprises a plate-shaped label having a price displaying unit; and a holder coupled to one side of the label and having a fixing portion protruding outward from the label.

The label may be an electronic shelf label (ELS) having a radio frequency (RF) chip through which wireless data communication can be performed.

The price displaying unit may be a liquid crystal display (LCD).

The holder may include a body portion of which a front portion is radially opened; an elasticity maintenance portion of which one end is inserted into the body portion; an elastic element which surrounds the elasticity maintenance portion and is mounted inside the body portion; and a fixing portion which is connected to a support portion extending from a rear side of the elasticity maintenance portion and of which an upper end is partially exposed to the outside of the label.

The body portion may include a plurality of divided pieces which are divided in such a manner that a hole is provided in the center thereof, and a cylindrical portion which extends from the divided pieces and has a lock protrusion formed therein.

The divided pieces may be divided into three or four equal parts.

The elasticity maintenance portion may have a key contact portion formed on the front end thereof and a lock portion provided behind the key contact portion.

The holder may be formed of a synthetic resin material having an elastic force.

According to another aspect of the invention, a price display apparatus comprises a plate-shaped label having a price displaying unit; a holder coupled to one side of the label and having a fixing portion protruding outward from the label; and a dedicated key inserted into a hole of the holder exposed to the one side of the label so as to elastically move the fixing portion.

The dedicated key may include a handle, a push stick formed at a front side of the handle, and a support portion formed between the push stick and the handle, the support portion having a polygonal step shape.

The price display apparatus may further comprise a label fixture having upper and lower rails through which the label is coupled to a front side thereof, and a hanging portion which is formed in a rear side thereof and through which the label fixture is disposed on a display stand.

The label fixture may have coupling grooves formed on the upper and lower rails.

The label may have a protrusion formed on the lower surface thereof.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a plan view of a price display apparatus according to the present inventive concept;

FIGS. 2 and 3 are partial cross-sectional views of the price display apparatus according to the present inventive concept;

FIG. 4 is a perspective view of a dedicated key adopted in the price display apparatus according to the present inventive concept; and FIG. 5 is a diagram showing a state before the price display apparatus according to the present inventive concept is mounted on a label fixture.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a plan view of a price display apparatus according to the present inventive concept. FIGS. 2 and 3 are partial cross-sectional views of the price display apparatus according to the present inventive concept. FIG. 4 is a perspective view of a dedicated key adopted in the price display apparatus according to the present inventive concept.

As shown in the drawings, the price display apparatus 100 includes a plate-shaped label 110 and a holder 120 coupled to one side of the label 110.

The label 110 is formed of a plate-shaped synthetic resin material having a predetermined thickness and includes a price displaying unit 111 which is formed on one surface of the label 110 so as to display price information, a barcode, and product information.

The label 100 has a radio frequency (RF) chip (not shown) mounted therein. Further, the label 100 is an electronic shelf label (ESL) which uses price information transmitted and received through the RF chip so as to display a price which can be applied in real time through the price displaying unit 111 and to manage the price information of a corresponding product in real time.

Any device which can display a price in an electronic manner may be used as the price displaying unit 111. For example, a liquid crystal display (LCD) may be used.

The holder 120 mounted in the label 110 includes a body portion 121 having a plurality of divided pieces 121*a*, an elasticity maintenance portion 122 of which one end is inserted into the body portion 121, and a fixing portion 124 connected to the elasticity maintenance portion 122 through a support portion 123.

The holder 120 may be mounted at one side of the label 110 such that the front sides of the divided pieces 121*a* of the body portion 121 are exposed to the side surface of the label 110, and the fixing portion 124 protrudes from any one of the top and bottom surfaces of the label 110.

The body portion 121 of the holder 120 further includes a cylindrical portion 121*b* extending from the divided pieces 121*a*. The divided pieces 121*a* may be divided into three or four equal parts so as to be radially opened. In a state in which the divided pieces 121*a* are not opened, a hole 121*c* into which a dedicated key 200 is to be inserted is provided in the center of the divided pieces 121*a*.

When the dedicated key 200 is inserted into the hole 121*c*, the divided pieces 121*a* are radially opened. The construction and operation of the dedicated key 200 will be described below.

An elastic element 125 such as a spring is mounted in the cylindrical portion 121*b* of the body portion 121, and the elasticity maintenance portion 122 is inserted into the elastic element 124 so as to maintain an elastic force. The body portion 121 has a lock protrusion 121*d* provided at the front side thereof.

The elasticity maintenance portion 122 extends from an end of the support portion 123 connected to the fixing portion 124 so as to be inserted into the cylindrical portion 121*a*. The elasticity maintenance portion 122 may include a key contact portion 122*a* which comes in contact with an insertion end of the dedicated key 200 and is formed at the front end thereof, and a lock portion 122*b* provided behind the key contact portion 122*a*.

The support portion 123 is formed at the rear side of the elasticity maintenance portion 122 so as to extend to the outside of the cylindrical portion 121*b*. The support portion 123 is repeatedly bent and straightened by an external force applied to the elasticity maintenance portion 122 and a repulsive force, respectively. The fixing portion 124 is provided at an end of the support portion 123 so as to partially protrude to the outside of the label 110. Further, the fixing portion 124 is elastically moved through the support portion 123.

The holder 120 mounted in the label 110 may be operated by the dedicated key 200 as shown in FIG. 4. The dedicated key 200 includes a handle 210 having a push stick 220 formed at the front side thereof, and a support portion 230 formed between the push stick 220 and the handle 210. The support portion 230 has a polygonal step shape.

The construction of the dedicated key 200 and the operation of the holder 120 using the dedicated key 200 will be described in more detail.

The push stick 220 formed at the front side of the dedicated key 200 is inserted into the hole 121*c* of the divided pieces 121*a* exposed to one side of the label 110 so as to come in contact with the key contact portion 122*a* of the elasticity maintenance portion 122 inserted into the cylindrical portion 121*a*.

An external force is applied through the handle of the dedicated key 200 so as to move the elasticity maintenance portion 122 to the rear side. At this time, the support portion 230 of the dedicated key 200 comes in contact with the inner circumferential surfaces of the divided pieces 121*a* so as to radially open the divided pieces 121*a* while sliding along the inner circumferential surfaces of the divided pieces 121*a*. Then, the push stick 200 is moved into the cylindrical portion 121*b* while pushing the key contact portion 122*a*.

When the elasticity maintenance portion 122 retreats inside the cylindrical portion 121*b*, the support portion 123 connected to the elasticity maintenance portion 122 is bent downward. Then, as shown in FIG. 3, the fixing portion 124 having protruded to the outside of the label 110 is elastically moved into the label 110.

In this state, when it is determined that the label 110 is disposed at a desired position, the external force applied to the dedicated key 200 coupled to the divided pieces 121*a* is released to separate the dedicated key 200 from the divided pieces 121*a*.

When the dedicated key 200 is separated, the elasticity maintenance portion 122 is elastically moved toward the divided pieces 121*a* by the repulsive force of the elastic element 125, and the support portion 123 is straightened. Then, the fixing portion 124 protrudes from the top surface of the label 110.

At this time, as the lock portion 122*b* of the elasticity maintenance portion 122 is locked and fixed to the lock protrusion 121*d* within the cylindrical portion 121*b*, the elasticity maintenance portion 122 is prevented from advancing.

Further, when the dedicated key 200 is removed, the elasticity maintenance portion 122 is moved toward the front side, and the divided pieces 121*a* return to the original position. Then, the key contact portion 122*a* is locked to the front side of the lock protrusion 121*d* formed in the cylindrical portion 121*b*. Therefore, the operation of the holder 120 can be performed only through the dedicated key 200.

Further, since the holder 120 is formed of synthetic resin having an elastic force, the RF communication of the RF chip mounted in the label 100 can be prevented from being interrupted.

Meanwhile, when the label 110 having the holder 120 mounted therein is fixed to a display stand, a separate fixture may be used. For example, a label fixture shown in FIG. 5 may be used.

FIG. 5 is a diagram showing a state before the price display apparatus according to the present inventive concept is mounted on the label fixture. As shown in FIG. 5, the label 110 having the holder 120 mounted in one side thereof is coupled to the label fixture 300 disposed on a display stand 400.

The label fixture 300 includes an upper rail 310, a lower rail 320, and a hanging portion 330 formed in the rear side thereof.

The label fixture 300 is disposed on the display stand 400 through the hanging portion 330, and the label 110 is mounted between the upper and lower rails 310 and 320. As described above, the label 110 is mounted through the dedicated key 200 such that the price displaying unit 111 faces the front side of the label fixture 300.

The upper and lower rails 310 and 320 have coupling grooves 311 and 321 formed thereon, respectively. The label 110 may be mounted on the label fixture 300 by inserting the elastically-moved fixing portion 124 into the coupling groove 311.

Meanwhile, a protrusion 126 may be formed on the lower surface of the label 110. The protrusion 126 may be inserted into the coupling groove 321 such that the label 110 is reliably coupled.

According to the price display apparatus of the present inventive concept, as the holder which is operated by only the dedicated key is mounted in one side of the label having the price displaying unit provided thereon, the label can be easily attached to and detached from the label fixture, and cannot be attached and detached by other tools except for the dedicated key. Therefore, it is possible to prevent the label from being stolen and lost.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A price display apparatus comprising:

a plate-shaped label having a price displaying unit; and a holder coupled to one side of the label and having a fixing portion protruding outward from the label, wherein the holder includes:

a body portion of which a front portion is radially opened;

an elasticity maintenance portion of which one end is inserted into the body portion;

an elastic element which surrounds the elasticity maintenance portion and is mounted inside the body portion; and a fixing portion which is connected to a support portion extending from a rear side of the elasticity maintenance portion and of which an upper end is partially exposed to the outside of the label.

2. The price display apparatus according to claim 1, wherein the label is an electronic shelf label (ELS) having a radio frequency (RF) chip through which wireless data communication can be performed.

3. The price display apparatus according to claim 1, wherein the price displaying unit is a liquid crystal display (LCD).

4. The price display apparatus according to claim 1, wherein the body portion includes a plurality of divided pieces which are divided in such a manner that a hole is provided in the center thereof, and a cylindrical portion which extends from the divided pieces and has a lock protrusion formed therein.

5. The price display apparatus according to claim 4, wherein the divided pieces are divided into three or four equal parts.

6. The price display apparatus according to claim 1, wherein the elasticity maintenance portion has a key contact portion formed on the front end thereof and a lock portion provided behind the key contact portion.

7. The price display apparatus according to claim 1, wherein the holder is formed of a synthetic resin material having an elastic force.

8. A price display apparatus comprising:

a plate-shaped label having a price displaying unit;

a holder coupled to one side of the label and having a fixing portion protruding outward from the label; and a dedicated key inserted into a hole of the holder exposed to the one side of the label so as to elastically move the fixing portion, wherein the dedicated key includes a handle, a push stick formed at a front side of the handle, and a support portion formed between the push stick and the handle, the support portion having a polygonal step shape.

9. The price display apparatus according to claim 8 further comprising:

a label fixture having upper and lower rails through which the label is coupled to a front side thereof, and a hanging portion which is formed in a rear side thereof and through which the label fixture is disposed on a display stand.

10. The price display apparatus according to claim 9, wherein the label fixture has coupling grooves formed on the upper and lower rails.

11. The price display apparatus according to claim 8, wherein the label has a protrusion formed on the lower surface thereof.

* * * * *